US011858771B2

(12) United States Patent
Iguchi

(10) Patent No.: US 11,858,771 B2
(45) Date of Patent: Jan. 2, 2024

(54) SHEET POST-PROCESSING DEVICE AND SHEET POST-PROCESSING METHOD

(71) Applicant: TOSHIBA TEC KABUSHIKI KAISHA, Tokyo (JP)

(72) Inventor: Ken Iguchi, Numazu Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/943,132

(22) Filed: Sep. 12, 2022

(65) Prior Publication Data

US 2023/0159295 A1 May 25, 2023

(30) Foreign Application Priority Data

Nov. 24, 2021 (JP) ..... 2021-189808

(51) Int. Cl.

| | |
|---|---|
| ***B65H 33/14*** | (2006.01) |
| ***B65H 31/30*** | (2006.01) |
| ***B65H 31/20*** | (2006.01) |
| ***B65H 43/02*** | (2006.01) |

(52) U.S. Cl.

CPC ..... *B65H 33/14* (2013.01); *B65H 31/20* (2013.01); *B65H 31/3036* (2013.01); *B65H 43/02* (2013.01); *B65H 2301/426* (2013.01); *B65H 2301/433* (2013.01); *B65H 2301/541* (2013.01)

(58) Field of Classification Search

CPC B65H 31/20; B65H 31/3009; B65H 31/3018; B65H 31/32; B65H 43/02; B65H 43/06; B65H 2301/426; B65H 2301/433; B65H 2301/541

USPC ..... 270/58.11, 58.14, 58.15, 58.18, 58.19, 270/58.28

See application file for complete search history.

(56) References Cited

U.S. PATENT DOCUMENTS

| | | | | |
|---|---|---|---|---|
| 7,134,656 | B2 * | 11/2006 | Terao | G03G 15/6541 270/58.11 |
| 7,549,621 | B2 * | 6/2009 | Kotani | B65H 29/36 270/58.08 |
| 7,798,481 | B2 * | 9/2010 | Terao | B65H 31/10 270/58.11 |
| 8,226,080 | B2 * | 7/2012 | Morita | B65H 31/36 270/58.12 |
| 9,481,540 | B2 * | 11/2016 | Miyajima | G03B 27/52 |
| 10,077,164 | B2 * | 9/2018 | Kotani | B65H 43/06 |
| 10,138,083 | B2 * | 11/2018 | Koyama | B65H 29/38 |

(Continued)

FOREIGN PATENT DOCUMENTS

JP 2009001421 A * 1/2009 ..... B65H 31/18

*Primary Examiner* — Leslie A Nicholson, III
(74) *Attorney, Agent, or Firm* — Kim & Stewart LLP

(57) ABSTRACT

According to one embodiment, a sheet post-processing device includes a first tray to receive sheets from an image forming unit, a second tray to receive sheets from the first tray, and a third tray to receive sheets from the second tray. The third tray is movable relative to the second tray. A bundle claw is configured to move sheets in a first direction from the second tray to the third tray. A controller is configured to move the third tray relative to the second tray according to the sheets on the second tray. Depending on various characteristics of the sheets on the second tray or the presence of sheets already on the third tray, the position of the third tray may be changed to reduce possible misalignments of sheets in the transfer from the second to third tray.

16 Claims, 9 Drawing Sheets

(56) References Cited

U.S. PATENT DOCUMENTS

| | | | | |
|---|---|---|---|---|
| 10,364,118 | B2 * | 7/2019 | Ishikawa | B65H 31/10 |
| 11,173,729 | B2 * | 11/2021 | Tamai | B41J 11/0045 |
| 2007/0152393 | A1 * | 7/2007 | Terao | B65H 31/10<br>270/58.13 |
| 2009/0057976 | A1 | 3/2009 | Iizuka | |
| 2011/0215520 | A1 * | 9/2011 | Tsuchiya | B65H 31/12<br>271/209 |

* cited by examiner

SHEET POST-PROCESSING DEVICE AND SHEET POST-PROCESSING METHOD

CROSS-REFERENCE TO RELATED APPLICATION

This application is based upon and claims the benefit of priority from Japanese Patent Application No. 2021-189808, filed Nov. 24, 2021, the entire contents of which are incorporated herein by reference.

FIELD

Embodiments described herein relate generally to a sheet post-processing device and a sheet post-processing method.

BACKGROUND

In related art, an image forming device can be equipped with a sheet post-processing device that processes ("post-processes") sheets after printing. Examples of post processing of the sheets include sorting and dividing sheets into a plurality of document copies and stapling processing of stapling each copy. After the sheets are post-processed in this manner, the post-processed sheets can be discharged as bundles (bundle-discharged) to a sheet discharge tray as a unit (bundled unit). For example, in a bundle discharge process, an upper surface of the sheet bundle on the sheet discharge tray is detected, and when no upper surface is detected, the sheet discharge tray is moved upward.

However, in the related art, when the sheets are to be bundle-discharged, the sheets might not be normally discharged depending on presence or absence of other sheets on the sheet discharge tray, and misalignment may occur with the sheets to be bundle-discharged.

DETAILED DESCRIPTION

In general, according to one embodiment, a sheet post-processing device and a sheet post-processing method capable of preventing misalignment in sheets to be bundle-discharged are provided.

A sheet post-processing device according to an embodiment, a sheet post-processing device includes a first tray to receive sheets from an image forming unit, a second tray to receive sheets from the first tray, and a third tray to receive sheets from the second tray. The third tray is movable relative to the second tray. A bundle claw is configured to move sheets in a first direction from the second tray to the third tray. A controller is configured to move the third tray relative to the second tray according to the sheets on the second tray.

A sheet post-processing device and a sheet post-processing method according to certain example embodiments will be described with reference to the drawings. In the following, components, elements, or aspects having the same or substantially similar functions are denoted by the same reference symbols. In addition, description of a duplicated component, element, or aspect may be omitted after an initial description.

First, an overall configuration of an image forming device 100 will be described with reference to FIG. 1.

Figure 1:
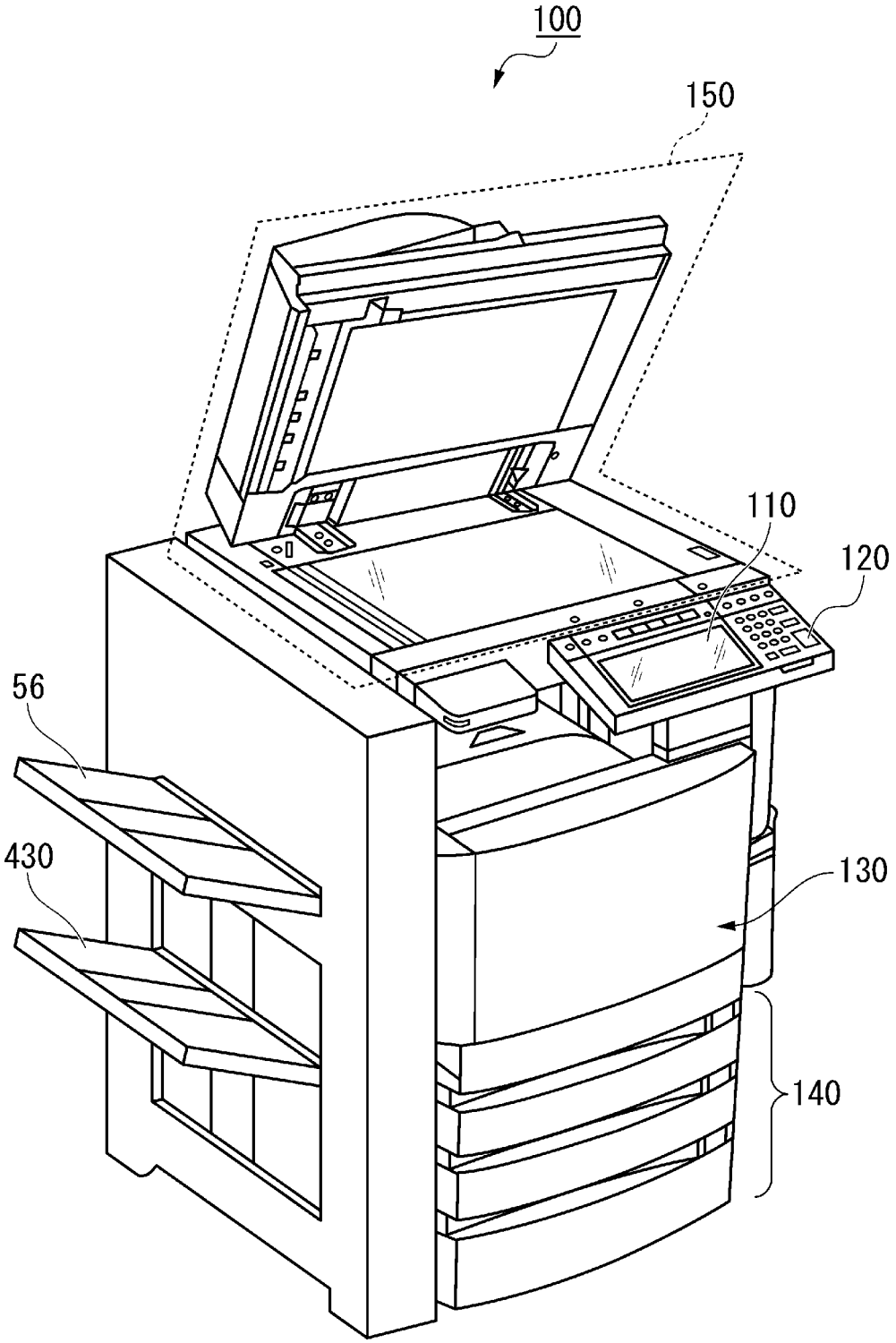
FIG. 1 is an external view of an image forming device according to an embodiment.

FIG. 1 is an external view illustrating an overall configuration example of the image forming device 100 according to an embodiment. The image forming device 100 is, for example, a multifunction peripheral. The image forming device 100 includes a display 110, a control panel 120, a printer 130, a sheet accommodating unit 140, and an image reading unit 150.

The display 110 is, for example, a liquid crystal display of a touch panel type. The display 110 displays various kinds of information. In addition, the display 110 receives an input operation from a user.

The control panel 120 includes various operation keys such as a numeric keypad and a start key. The control panel 120 receives various input operations from the user. For example, the control panel 120 receives an input operation relating to post processing. Examples of post processing include a sorting processing for sorting sheets into a plurality of copies, stapling processing for stapling each copy, and punching processing for punching holes in predetermined positions of sheets. In addition, the control panel 120 outputs operation signals corresponding to the various input operations received from the user to a control unit.

The printer 130 performs a series of printing operations based on various kinds of information output from the display 110, the control panel 120, the image reading unit 150, and the like. The series of printing operations include receiving image information, forming an image, transferring the formed image to a sheet, conveying a sheet, and the like.

The sheet accommodating unit 140 includes a plurality of sheet cassettes. Each sheet cassette accommodates sheets therein. These sheets are usually normal copy sheets (plain paper), but may also sheets of other types such as a photographic sheet, a label sheet, a polyester film sheet, and the like.

The image reading unit 150 includes an automatic document sheet feeder and a scanner device. The automatic document sheet feeder feeds a document placed on a document tray to the scanner device. The scanner device optically scans a document on a document glass stand, and forms an image of reflected light from the document on a light-receiving surface of a charge coupled device (CCD) sensor.

Accordingly, the scanner device reads a document image on the document glass stand. The image reading unit 150 generates image information (image data) by using a result of reading by the scanner device.

In FIG. 1, the image forming device 100 includes a fixed tray 56 and a movable tray 430. The fixed tray 56 is a tray at a fixed position to which the sheets can be discharged. The sheets can be discharged to the fixed tray 56 in the following cases.

- A case in which the number of the sheets to be printed is less than a predetermined number.
- A case in which just one copy is to be printed.
- A case in which two or more copies are to be printed, but are to be printed page by page.

The movable tray 430 is a tray that moves up and down. The sheets can be discharged to the movable tray 430 in the following cases.

- A case in which the number of the sheets to be printed is more than a predetermined number.
- A case two or more copies are to be printed, but are to be printed as separate copies.

Figure 2:
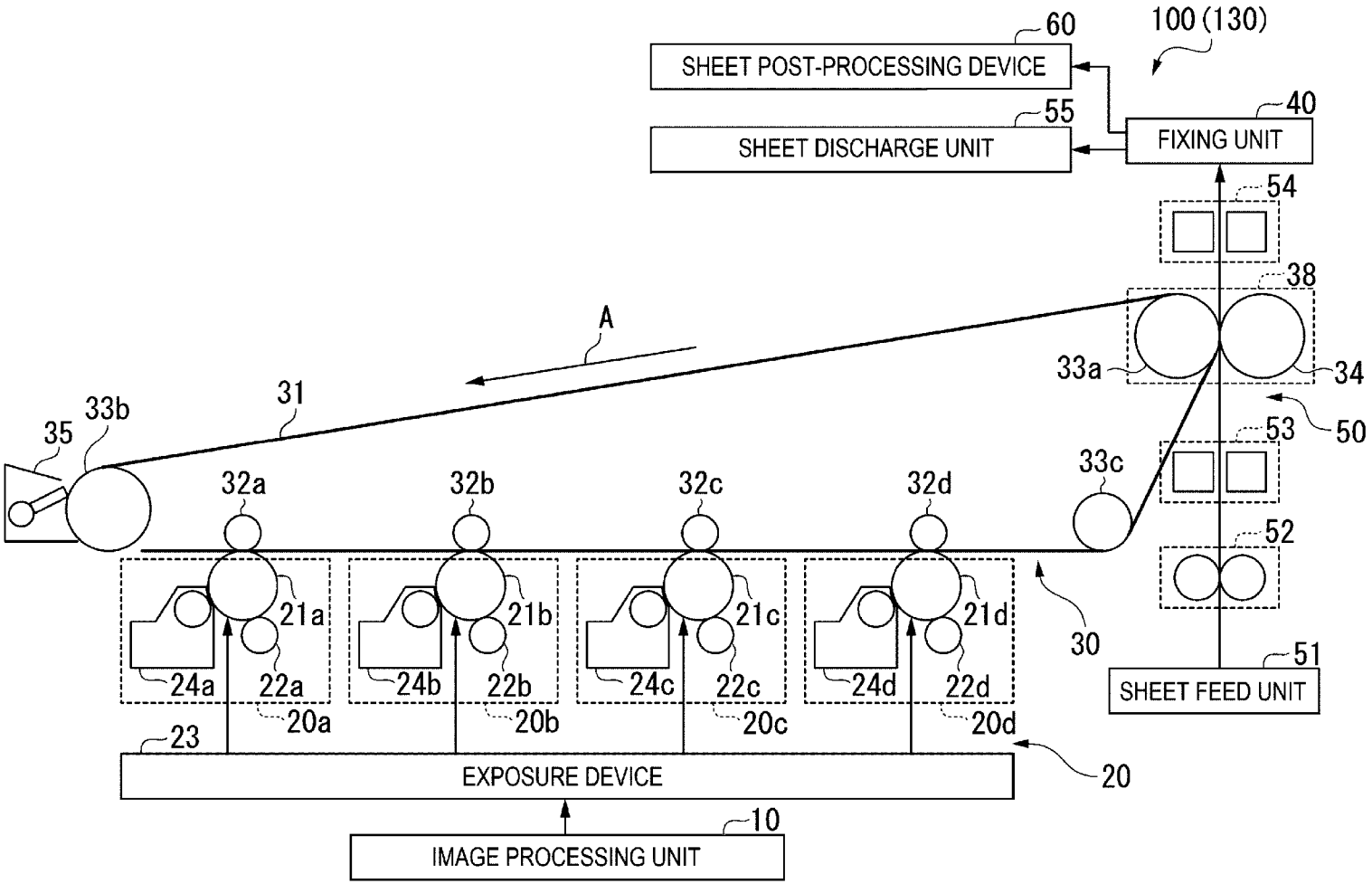
FIG. 2 is a diagram of an internal configuration of an image forming device.

FIG. 2 is a diagram illustrating an example of an internal configuration of the image forming device 100. As illustrated in FIG. 2, the image forming device 100 (more particularly, the printer 130 portion of the image forming device 100) includes four image forming units 20*a* to 20*d*. The image forming device 100 is of a so-called quadruple tandem type in this example. The image forming device 100 includes an image processing unit 10, an image forming unit 20 (including units 20*a* to 20*d*), an intermediate transfer unit 30, a fixing unit 40, a sheet conveying unit 50, and a sheet post-processing device 60.

The image processing unit 10 receives the image information (print data). The received image information can be generated by the image reading unit 150 or transmitted from another device. The image processing unit 10 performs digital image processing for processing the received image information according to an initial setting or a setting selected by the user. For example, the digital image processing includes gradation correction based on gradation correction data. In addition to the gradation correction, the digital image processing includes various correction processing that may be made to the image data such as color correction or shading correction as well as processing such as compression.

Next, the image forming unit 20 will be described. The image forming unit 20 includes the image forming unit 20*a* corresponding to Y (yellow), the image forming unit 20*b* corresponding to M (magenta), the image forming unit 20*c* corresponding to C (cyan), and the image forming unit 20*d* corresponding to K (black). The image forming units 20*a* to 20*d* respectively include photoconductor drums 21*a* to 21*d*, chargers 22*a* to 22*d*, an exposure device 23, developing devices 24*a* to 24*d*, and a drum cleaning device. In the following, the reference numerals a to d will be omitted since the description applies to each image forming unit 20*a* to 20*d*.

The photoconductor drum 21 is, for example, an organic photo-conductor (OPC) of a charge type in which an undercoat layer, a charge generation layer, and a charge transport layer are sequentially laminated on a circumferential surface of a conductive cylinder made of aluminum. The photoconductor drum 21 changes conductivity in response to light.

The charger 22 generates corona discharge. The charger 22 uniformly charges a surface of the photoconductor drum 21.

The exposure device 23 is, for example, a semiconductor laser. The exposure device 23 irradiates the photoconductor drum 21 with laser light corresponding to an image of each color component. When the laser light is irradiated by the exposure device 23, a potential of a region irradiated with the laser light is changed on the surface of the photoconductor drum 21. Due to this change in conductivity, an electrostatic latent image is formed on the surface of the photoconductor drum 21.

The developing device 24 accommodates a developer. The developing device 24 attaches a toner of a respective color component to the surface of the respective photoconductor drum 21. Accordingly, a toner image of one color toner is formed on the photoconductor drum 21. That is, the electrostatic latent image formed on the surface of the photoconductor drum 21 is developed.

Here, the developer will be described. As the developer, for example, a two-component developer is used. The two-component developer includes a non-magnetic toner and a carrier. For the carrier, for example, iron powder having a particle diameter of several tens of microns (μm) or a polymer ferrite particle is used. The carrier is mixed with the toner in the developing device 24, and is frictionally charged, thereby giving a charge (for example, a negative charge) to the toner particles. In addition, the carrier conveys the toner to the electrostatic latent image by a magnetic force.

The drum cleaning device includes a cleaning blade in contact with the surface of the photoconductor drum 21. The cleaning blade removes a residual toner remaining on the surface of the photoconductor drum 21 after primary transfer. The removed residual toner is collected in an accommodating unit of the drum cleaning device.

Next, the intermediate transfer unit 30 will be described. The intermediate transfer unit 30 includes an intermediate transfer body 31, a primary transfer roller 32, a plurality of support rollers 33, a secondary transfer roller 34, a belt cleaning device 35, and the like.

The intermediate transfer body 31 is, for example, an endless belt (transfer belt). The intermediate transfer body 31 is not substantially conductive or elastic. Specifically, for example, the intermediate transfer body 31 is a belt made of polyimide. However, in other examples, the intermediate transfer body 31 may have conductivity and elasticity.

The support rollers 33*a* to 33*c* support the intermediate transfer body 31 such that tension is applied to the intermediate transfer body 31. Accordingly, the intermediate transfer body 31 is formed in a loop shape. One of the plurality of support rollers 33*a* to 33*c* (for example, the support roller 33*a*) is a drive roller. The rollers other than the drive roller are driven rollers. When the driving roller is rotated (by a motor or the like), the intermediate transfer body 31 travels in the direction A depicted in FIG. 2 at a predetermined speed and in a predetermined cycle.

The primary transfer roller 32 is disposed to face the photoconductor drum 21 with the intermediate transfer body 31 interposed therebetween. Specifically, the primary transfer roller 32 is disposed so as to apply a pressure on the photoconductor drum 21 with the intermediate transfer body 31 interposed therebetween. Accordingly, the primary transfer roller 32 and the photoconductor drum 21 form a primary transfer unit that nips the intermediate transfer body 31.

When the intermediate transfer body 31 passes through the primary transfer unit, the toner image formed on the photoconductor drum 21 is transferred to the intermediate transfer body 31. When the intermediate transfer body 31 passes through the primary transfer unit, a primary transfer bias is applied to the primary transfer roller 32. Specifically, for example, a charge having a polarity (e.g., a positive polarity) opposite to that of the toner (is applied to the primary transfer roller 32. Accordingly, the toner image formed on the photoconductor drum 21 is electrostatically transferred to the intermediate transfer body 31.

The secondary transfer roller 34 is disposed to face the support roller 33*a* with the intermediate transfer body 31 interposed therebetween. Specifically, the secondary transfer roller 34 is disposed so as to apply a pressure on the support roller 33*a* with the intermediate transfer body 31 interposed therebetween. Accordingly, the secondary transfer roller 34 and the support roller 33*a* form a secondary transfer unit 38 that brings the intermediate transfer body 31 into contact with the sheets being printed.

When a sheet pass through the secondary transfer unit 38, the toner image formed on the intermediate transfer body 31 is transferred to the sheet. When the sheets pass through the secondary transfer unit 38, a secondary transfer bias is applied to the support roller 33*a*. Specifically, a charge having the same polarity (e.g., a negative polarity) as that of the toner is applied to the support roller 33*a*. Accordingly, the toner image on the intermediate transfer body 31 is electrostatically transferred to the sheets.

The secondary transfer roller 34 and the support roller 33*a* can be separated from each other. Accordingly, when the sheets are jammed in the secondary transfer unit 38, the user can remove the sheets.

The belt cleaning device 35 includes a cleaning blade in contact with a surface of the intermediate transfer body 31. The cleaning blade removes any residual toner remaining on the surface of the intermediate transfer body 31 after the secondary transfer. The removed residual toner is collected in an accommodating unit of the belt cleaning device 35.

The fixing unit 40 heats and presses the sheets to which the toner image has been transferred. The fixing unit 40 is, for example, a roller-type fixing unit including a heated roller that heats the sheets and a pressing roller that is pressed against the heated roller. Accordingly, the fixing unit 40 fixes the toner image onto the sheets. The fixing unit 40 can also adopt a method of fixing toner images to the sheets by heating of a film member interposed therebetween.

Next, the sheet conveying unit 50 will be described. The sheet conveying unit 50 includes a sheet feed unit 51, a registration unit 52, a first guide unit 53, a second guide unit 54, and a sheet discharge unit 55.

The sheet feed unit 51 conveys the sheets accommodated in the sheet accommodating unit 140 one by one to the registration unit 52. The registration unit 52 stops each sheets being conveyed from the sheet feed unit 51 and then feeds the sheet toward the secondary transfer unit 38 at a timing appropriate for toner image transfer to the sheet. The appropriate timing in this context is the timing at which the toner image formed on the intermediate transfer body 31 can be secondarily transferred by the secondary transfer unit 38 to the sheet at a correct position. The first guide unit 53 restricts movement of the sheets fed from the registration unit 52 to the secondary transfer unit 38.

The secondary transfer unit 38 transfers the toner image to the sheets after the first guide unit 53. The secondary transfer unit 38 then feeds the sheets to which the toner image has been transferred toward the fixing unit 40.

The second guide unit 54 restricts movement of the sheets fed from the secondary transfer unit 38 to the fixing unit 40. The fixing unit 40 heats and presses the sheets after the second guide unit 54, and then feeds the sheets to the sheet discharge unit 55 or the sheet post-processing device 60. The sheet discharge unit 55 simply discharges the sheets to the fixed tray 56 (see FIG. 1).

The sheet post-processing device 60 post-processes the sheets fed from the fixing unit 40, and discharges sheets to the movable tray 430 (see FIG. 1). After post processing, such as the sorting processing and the stapling processing, is performed, the sheet post-processing device 60 discharges the sheets as a group (bundle) to the movable tray 430. The post processing for sorting includes a process of aligning the sheets with respect to one another. The post processing for stapling includes a process of aligning the sheets as well as stapling of the aligned sheets.

Next, a hardware configuration of the image forming device 100 will be described with reference to FIG. 3.

Figure 3:
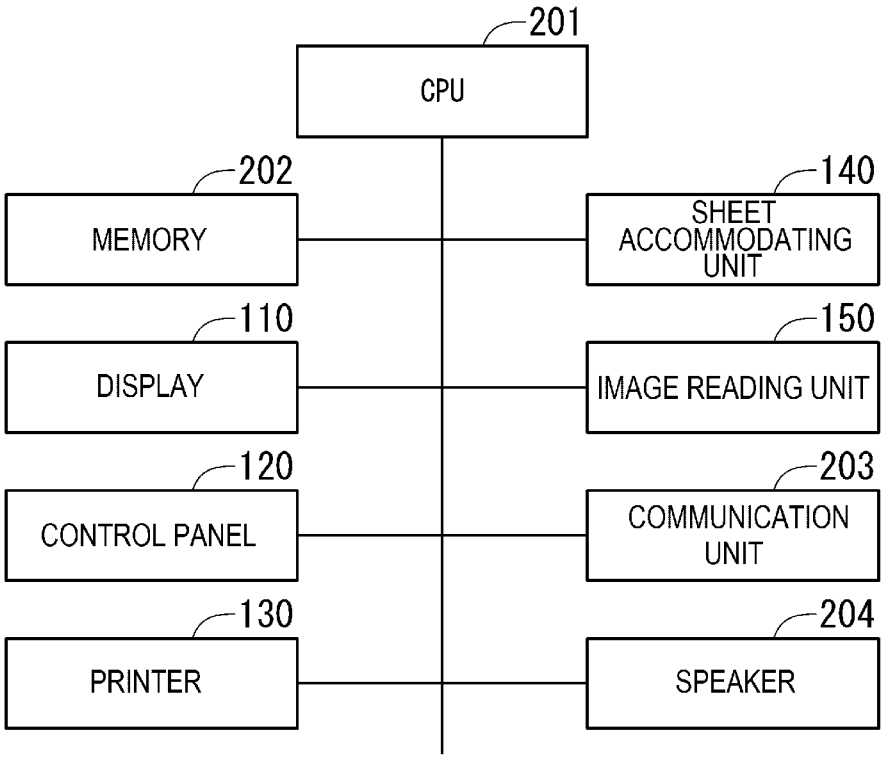
FIG. 3 depicts a hardware configuration of an image forming device.

FIG. 3 is an explanatory diagram illustrating an example of the hardware configuration of the image forming device 100. As illustrated in FIG. 3, the image forming device 100 includes, in addition to the already described configurations, a central processing unit (CPU) 201, a memory 202, a communication unit 203, and a speaker 204. These components can communicate with each other via a bus.

The CPU 201 is a central processing unit, and controls each unit illustrated in FIG. 3 by reading and executing various programs stored in the memory 202. The various programs include a sheet post-processing program according to the present embodiment.

The memory is a ROM, a RAM, a hard disk, or the like. The ROM is a read-only memory, and stores various kinds of information used by the CPU, such as a program. The RAM is a memory that can be read and written, and stores various kinds of information. For example, the RAM stores information acquired from the outside and information generated in various processing. The hard disk stores various kinds of information.

The communication unit 203 is an interface that transmits and receives information to and from other devices.

The speaker 204 outputs sound.

Next, configuration examples and general operation examples of the sheet post-processing device 60 will be described with reference to FIGS. 4 to 7.

Figure 4:
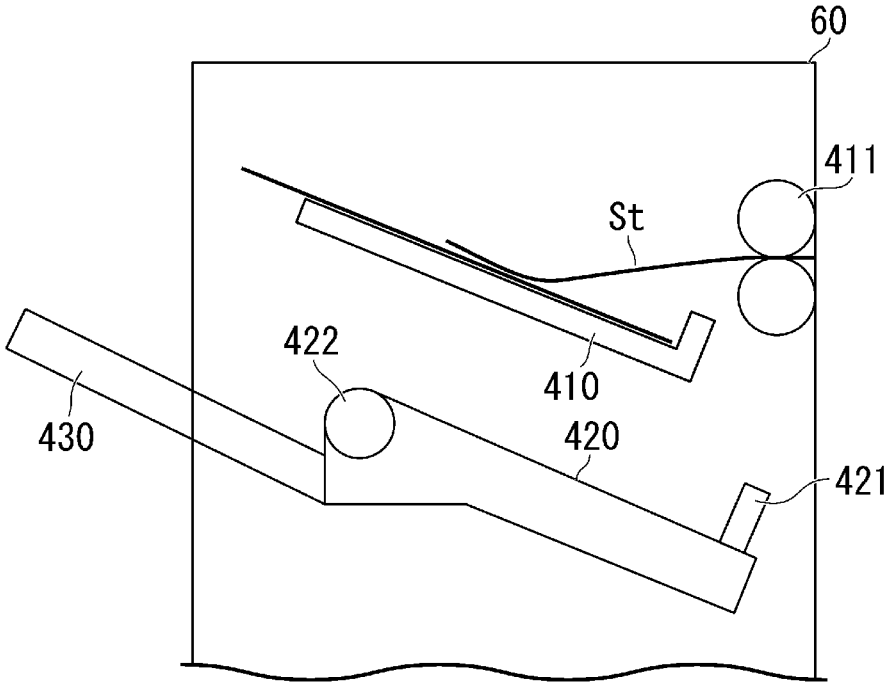
FIG. 4 depicts aspects of a sheet post-processing device.
Figure 5:
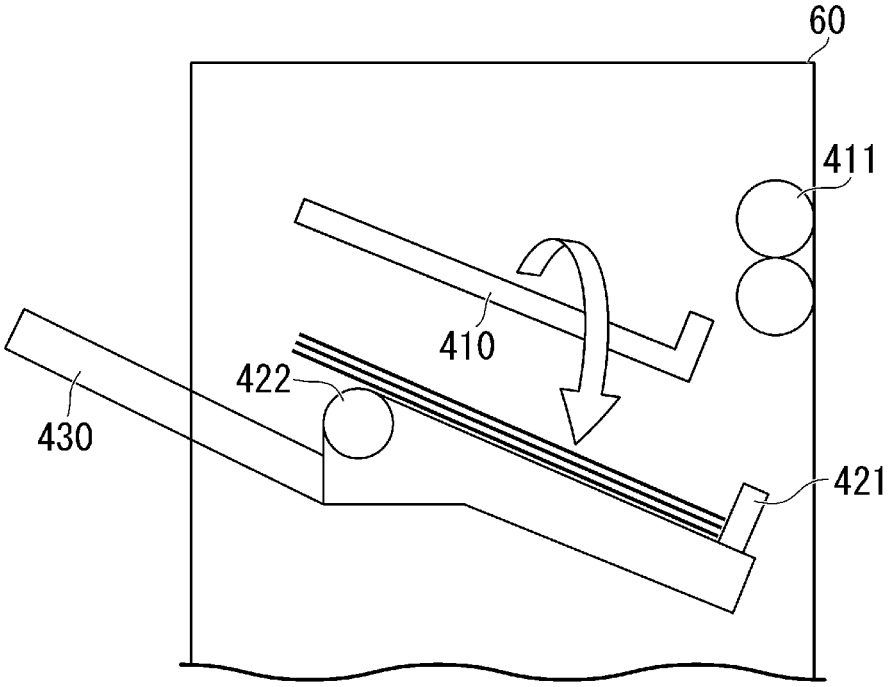
FIG. 5 depicts aspects of a sheet post-processing device.

FIGS. 4 to 7 are explanatory diagrams illustrating examples of configurational aspects and general operations of the sheet post-processing device 60. As depicted in FIG. 4, the sheet post-processing device 60 includes a standby tray 410, a processing tray 420, and the movable tray 430. The standby tray 410 is a fixed tray that stands by (buffers) until the number of sheets St fed from a conveying roller 411 reaches a predetermined number (hereinafter referred to as a "buffer number"). The buffer number is, for example, three. When the number of the sheets St on the standby tray 410 reaches the buffer number then, as illustrated in FIG. 5, the sheets St on the standby tray 410 are automatically moved to the processing tray 420.

The processing tray 420 is an example of a processing placement unit. In the stapling processing, the processing tray 420 stores the sheets St as needed. The processing tray 420 is a fixed tray on which the sheets St are aligned and wait until the number of sheets St reaches the number for bundle discharge (hereinafter referred to as a "bundle discharge number"), and a post processing is performed after the bundle discharge number is reached. In the stapling processing, the bundle discharge number is the number of pages in a document copy to be stapled together as a unit. In the sorting processing, the bundle discharge number can be equal to the buffer number. That is, in the sorting processing, the processing tray 420 aligns the sheets St each time the sheets St reach the buffer number (the bundle discharge number) in the standby tray 410 and thus are moved to the processing tray 420, and then discharges the aligned sheets St to the movable tray 530.

A bundle claw 421 is disposed on one end (a main body side) of the processing tray 420, and a discharge roller 422 is disposed on the other end (a discharge side). The bundle claw 421 includes a moving mechanism that moves from a standby position illustrated in FIG. 5 to an advanced position illustrated in FIG. 7. When the bundle discharge number is reached on the processing tray 420 and the post processing has been performed as needed, the bundle claw 421 pushes out the bundled sheets St toward the movable tray 430.

Figure 6:
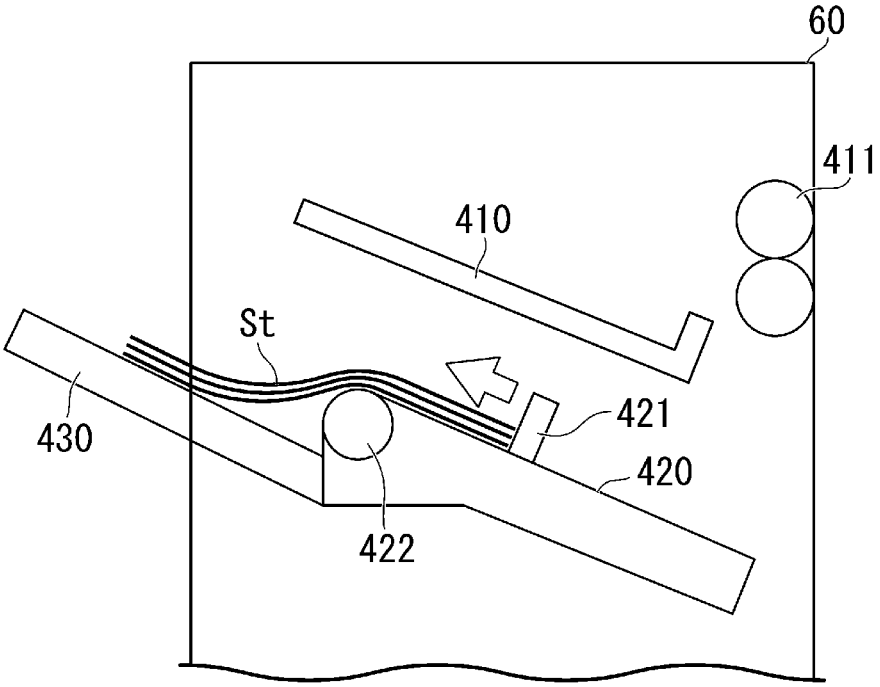
FIG. 6 depicts aspects of a sheet post-processing device.

The discharge roller 422 feeds the sheets St pushed out by the bundle claw 421 to the movable tray 430. The discharge roller 422 may be a driven roller, or may be a passive roller that rotates freely as the sheets St are discharged. When the number of the sheets St on the processing tray 420 reaches the bundle discharge number, the bundle claw 421 pushes out the bundled sheets St as illustrated in FIG. 6. As illustrated, the sheet post-processing device 60 according to the present embodiment is not provided with a pinch roller or the like that faces the discharge roller 422. Therefore, when the sheets St are discharged from the processing tray 420 to the movable tray 430 there is no pressing on the bundle from above (such as would be the case with a pinch roller opposite the discharge roller 422).

Figure 7:
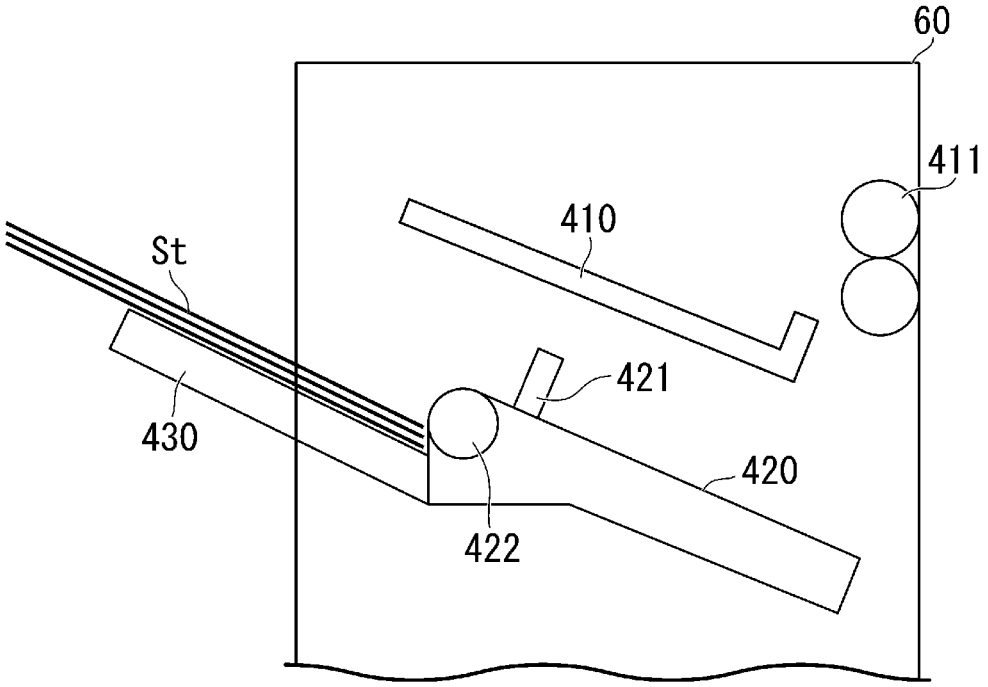
FIG. 7 depicts aspects of a sheet post-processing device.

As illustrated in FIG. 7, when the bundle claw 421 reaches the advanced position, the sheets St pushed out by the bundle claw 421 are placed on the movable tray 430 with the discharge roller 422 interposed therebetween. The movable tray 430 is an example of a movable placement unit. The movable tray 430 receives the sheets St discharged from the processing tray 420. The movable tray 430 includes a mechanism that can move up and down. A height of the movable tray 430 can be appropriately changed according to an amount of the sheets St to be placed thereon, for example.

Here, an example of a case where misalignment occurs in the sheets St to be bundle-discharged will be described with reference to FIGS. 8A and 8B.

Figure 8A:
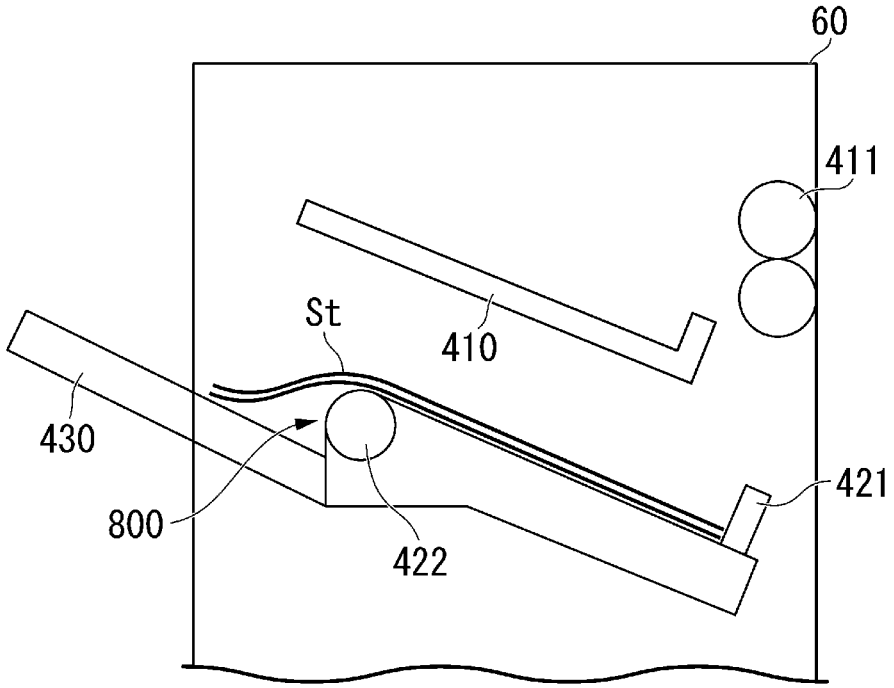
FIG. 8A depicts an example of a case where misalignment occurs in sheets to be bundle-discharged.
Figure 8B:
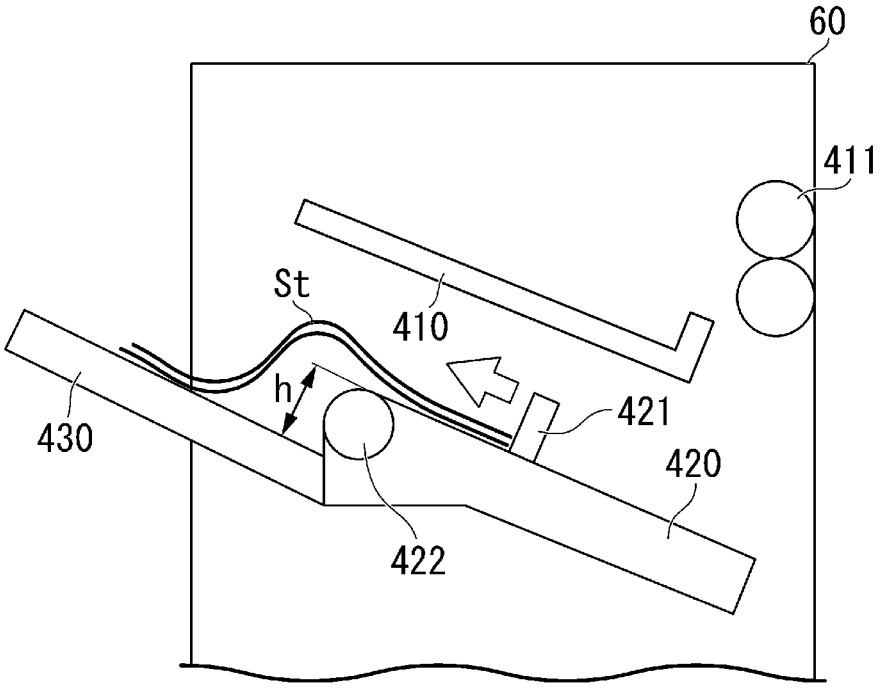
FIG. 8B depicts an example of a case where misalignment occurs in sheets to be bundle-discharged.

FIGS. 8A and 8B are explanatory diagrams illustrating an example of a case where misalignment occurs in the sheets St to be bundle-discharged. In FIG. 8A, it is assumed that no sheets St are initially on the movable tray 430. For example, if a large step 800 is present between the processing tray 420 and the movable tray 430, the sheets St stand by in a deflected state (that is, the sheets St bend or bow downward). When the bundle discharge is performed in this situation, the relationship between the force (conveying force) moving the sheets St onto the movable tray 430 and the resistance force (friction force) due to contact between the tip portions of the sheets St being moved and the movable tray 430, the resistance force may be larger than the conveying force. Accordingly, as illustrated in FIG. 8B, the sheets St being moved onto the movable tray 430 are likely to be additionally deflected and may not be discharged normally, resulting in misalignment of the sheets St.

Such deflection when the sheets St are discharged tends to occur more easily as the step 800 becomes larger. In addition, such deflection can be more significant when longer type sheets St are used, or when a total weight of the sheets St being transferred is low.

When the sheets St are already on the movable tray 430 when additional sheets St are being moved on the movable tray 430, the relevant contact resistance is that between the different sheets St. However, since an air layer may be initially formed between the individual sheets St, the contact resistance between such individual sheets St can be lower than the resistance force due between sheets St and the movable tray 430. That is, when the sheets St are already present on the movable tray 430, issues with sheet deflection when additional sheets St are discharged are considered less likely to occur.

Therefore, the sheet post-processing device 60 according to the present embodiment adjusts a position of the movable tray 430 based on presence or absence of the sheets St already on the movable tray 430 when a bundle discharge is performed.

Figure 9:
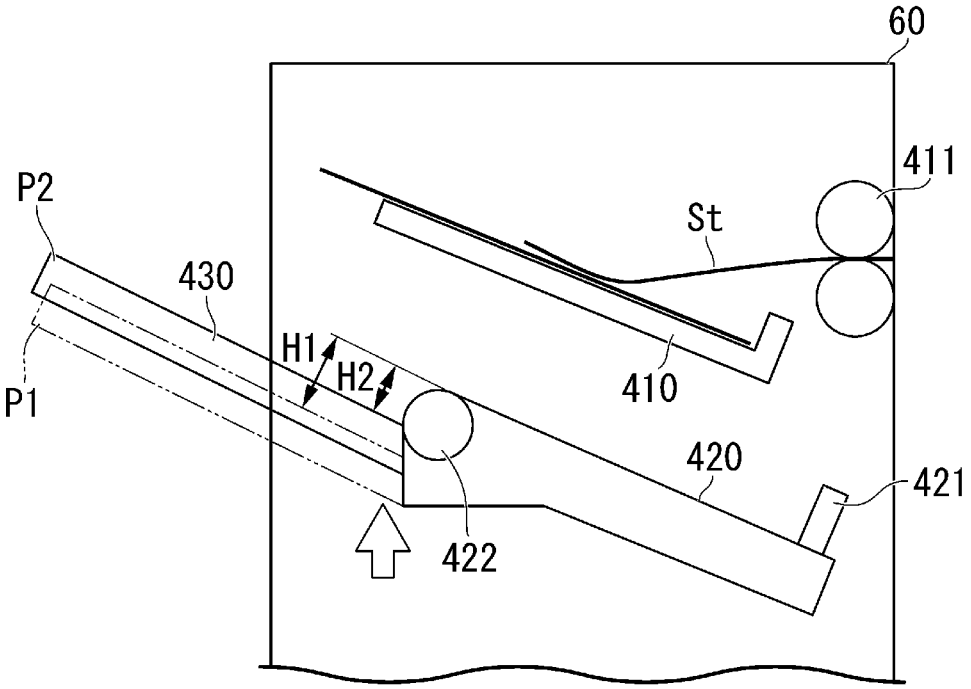
FIG. 9 illustrating an example when a position of a movable tray is changed.

FIG. 9 is an explanatory diagram illustrating an example of a case where the position of the movable tray 430 is changed in the present embodiment. When a bundle discharge is performed, the movable tray 430 is disposed at a first position (hereinafter referred to as a "first discharge position P1") higher than a standby position in a normal control. In addition, as illustrated in FIG. 9, when sheets St are not already on the movable tray 430, the movable tray 430 is disposed at a second position (hereinafter referred to as a "second discharge position P2") higher than the first discharge position P1. At the second discharge position P2, a difference H2 in height between a surface of the processing tray 420 and a surface of the movable tray 430 is smaller than a difference H1 at the first discharge position P1.

Figure 10:
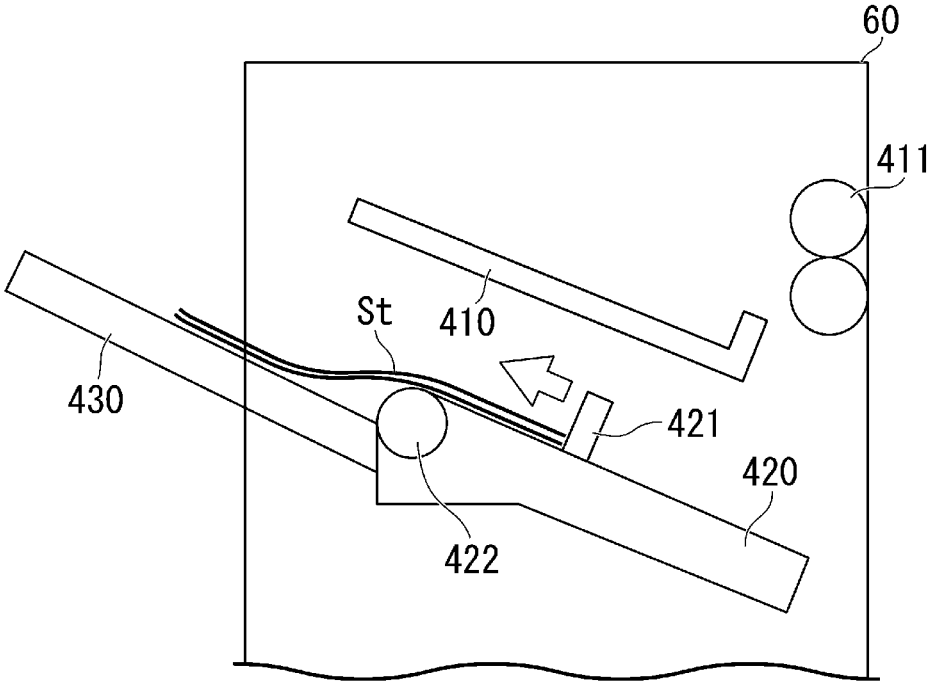
FIG. 10 depicts an operation example of bundle discharge when a movable tray is moved to another discharge position.

FIG. 10 is an explanatory diagram illustrating an operation example of the bundle discharge when the movable tray 430 is moved to the second discharge position P2. In FIG. 10, it is assumed that no sheets St are on the movable tray 430 initially. As illustrated in FIG. 10, since the height (the difference H2) between the surface of the processing tray 420 and the surface of the movable tray 430 is reduced, the resistance force due to the contact between the sheets St and the movable tray 430 can be made smaller than the conveying force of the tip portions of the sheets St on the movable tray 430 side. Therefore, the deflection of the sheets St can be made less likely to occur even when no sheets St are on the movable tray 430 in the bundle-discharge.

Next, a functional configuration of the sheet post-processing device 60 included in the image forming device will be described with reference to FIG. 11.

Figure 11:
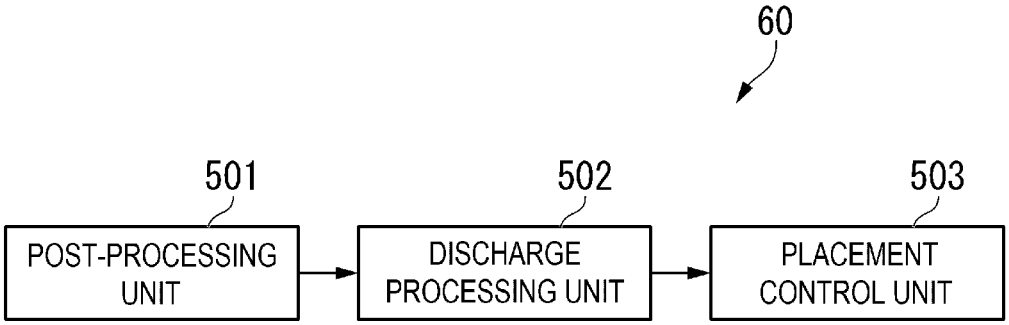
FIG. 11 depicts a functional configuration of a sheet post-processing device.

FIG. 11 is an explanatory diagram illustrating an example of the functional configuration of the sheet post-processing device 60. The sheet post-processing device 60 includes a post-processing unit 501, a discharge processing unit 502, and a placement control unit 503. Each of the units 501 to 503 is implemented by the CPU 201. That is, the CPU 201 implements functions of the units 501 to 503 by executing a sheet post-processing program stored in memory. The CPU 201 is not limited to performing the processing according to the present embodiment by executing programs, and can also perform the processing according to the present embodiment by using, for example, hardware (a circuit unit; including circuitry) such as a large scale integration (LSI) circuit, an application-specific integrated circuit (ASIC), a field-programmable gate array (FPGA), or a graphics processing unit (GPU), and can also perform the processing according to the present embodiment by a cooperation of software and hardware.

The post-processing unit 501, the discharge processing unit 502, and the placement control unit 503 are not limited to being implemented by the CPU 201 of the image forming device 100. For example, when the sheet post-processing device 60 itself includes a CPU, each of the units 501 to 503 may be implemented by a CPU included in the sheet post-processing device 60.

The post-processing unit 501 causes the processing tray 420 to stand by until the number of the conveyed sheets St reaches the bundle discharge number (a predetermined number). Then, the post-processing unit 501 post-processes the sheets St of the bundle discharge number as a bundle. Examples of the post processing include sorting processing, stapling processing, and punching processing. The post-processing unit 501 performs the post processing whenever the post processing is set to be performed. The post processing can be selected based on an operation input by a user using the control panel 120 or based on setting information received from another device (a user terminal such as a personal computer) by using the communication unit 203. Hereinafter, printing for which the post processing is set may be referred to as a "post-processing mode" printing.

The discharge processing unit 502 discharges the bundle of sheets St post-processed by the post-processing unit 501 to the movable tray 430. Specifically, the discharge processing unit 502 controls the bundle claw 421 to discharge (bundle-discharge) the bundle of sheets St to the movable tray 430.

The placement control unit 503 performs control to change the position of the movable tray 430 with respect to the processing tray 420 based on the presence or absence of the sheets St on the movable tray 430 before the sheets St are discharged to the movable tray 430 by the discharge processing unit 502. The presence or absence of the sheets St on the movable tray 430 can be detected by a sensor included in the image forming device 100. The sensor is provided proximate to the movable tray 430.

Specifically, the placement control unit 503 disposes the movable tray 430 at the first discharge position P1 (see FIG. 9) when the post-processing mode is started. The first discharge position P1 is higher than a normal disposing position (normal position) (In this context, the normal position is the movable tray 430 position when post-processing is not being performed on the sheets St being printed). In addition, when sheets have not yet been placed on the movable tray 430 in the post-processing mode, the placement control unit 503 adjusts the position of the movable tray 430 to the second discharge position P2, which is different from the first discharge position P1. In particular, the second discharge position P2 is higher than the first discharge position P1.

As described above, the deflection in a bundle discharge can be more significant when longer sheets St are being printed. Therefore, in some examples, when sheets St are not yet on the movable tray 430, the placement control unit 503 may change the position of the movable tray 430 in view of the size of the sheets St to be printed. For example, when the sheets St are long in a sub-scanning direction, the placement control unit 503 adjusts the position of the movable tray 430 accordingly.

Specifically, if A3 size sheets (which are longer than in usual sub-scanning direction than a A4 size sheet or a plain letter page sheet) are being printed, then when the sheets St are discharged the height of the movable tray 430 is adjusted. For example, when at least one long-type sheet St is present in the sheets St to be bundle-discharged, then such a long-type sheet St may be deflected. Therefore, in the present embodiment, when at least one sheet St having a long size is present in the sheets St to be bundle-discharged, the placement control unit 503 changes the position of the movable tray 430. However, the position of the movable tray 430 in some examples need not be changed if the post processing is being performed on mixed A3 size and A4 size sheets but an A4 size sheet is positioned at a lowest position in the bundle (stack).

As described above, the deflection in a bundle discharge can be more significant when the weight of the sheets St is lower. Therefore, when sheets St are not presently on the movable tray 430, the placement control unit 503 may change the position of the movable tray 430 based on a weight of the sheets St. For example, the placement control unit 503 changes the position of the movable tray 430 when the sheets St are expected to be of a weak stiffness, such as when the weight of the sheets St being printed is equal to or less than some predetermined value.

In this context, the matter of the weight of the sheets St being equal to or less than a predetermined value can be based on the per sheet weight of the sheets being printed being equal to or less than 90 g/m$^2$. For example, when at least one sheet St having a weak stiffness is present in the sheets St to be bundle-discharged, this sheet St having a weak stiffness may be deflected. Therefore, in the present embodiment, the placement control unit 503 changes the position of the movable tray 430 when at least one sheet St having a weak stiffness is known to be present in the sheets to be bundle-discharged.

In the present embodiment, the placement control unit 503 may change the position of the movable tray 430 based on both the size of the sheets St and the weight of the sheets St. However, the present embodiment is not limited thereto, and the placement control unit 503 may change the position of the movable tray 430 based on either the size of the sheets St or the weight of the sheets St alone.

Here, since the post-processed sheets St on the movable tray 430 are printed in groups corresponding to a complete document, some of the sheets St may be removed by the user even though not all the printing is ended (that is, some copies still remain to be printed). Thus, sheets St on the movable tray 430 may be removed even during the printing process. Therefore, in the present embodiment, when a plurality of copies are to be printed, the presence or absence of sheets St on the movable tray 430 can determined for each copy to be discharged to the movable tray 430.

Specifically, the placement control unit 503 determines the presence or absence of the sheets St on the movable tray 430 each time a sheet St reaches the processing tray 420 up until the bundle discharge number. In the present embodiment, the placement control unit 503 also performs a similar determination in a process of buffering the sheets St fed from the conveying roller 411 in the standby tray 410.

The placement control unit 503 changes the position of the movable tray 430 whenever it is determined there are no sheets already on the movable tray 430 but sheets still remain to be discharged to the movable tray 430. In the present embodiment, the placement control unit 503 changes the position of the movable tray 430 whenever it is determined that no sheets St are on the movable tray 430. However, the determination of the presence or absence of the sheets St on the movable tray 430 is not limited to being performed in the conveying process of every one of the sheets St, and in other examples may be performed in a conveying process of just a last sheet St in the bundle discharge.

In addition, the deflection of the sheets St tends to be less likely to occur as the bundle discharge number becomes larger, that is, as the bundle of sheets St gets heavier. Therefore, in the present embodiment, when the bundle discharge number is equal to or greater than a threshold value, the placement control unit 503 does not change the position of the movable tray 430 regardless of the presence or absence of the sheets St on the movable tray 430. The threshold value can be set as appropriate. In the present embodiment, the threshold value is, for example, 10.

The placement control unit 503 can perform control of changing the position of the movable tray 430 in a mode other than the post-processing mode. For example, even in a normal control (no post-processing) mode. In normal control the movable tray 430 would generally only be raised or lowered according to the number of discharged sheets St whenever a predetermined number or more of sheets St is to be printed. However, the movable tray 430 may be raised excessively if such normal control was to be performed when the movable tray 430 is disposed at the second discharge position P2. Therefore, in the present embodiment, the placement control unit 503 is configured to not perform normal control when the movable tray 430 is disposed at the second discharge position P2.

Next, discharge processing in the post-processing mode performed by the image forming device 100 will be described with reference to FIG. 12.

Figure 12:
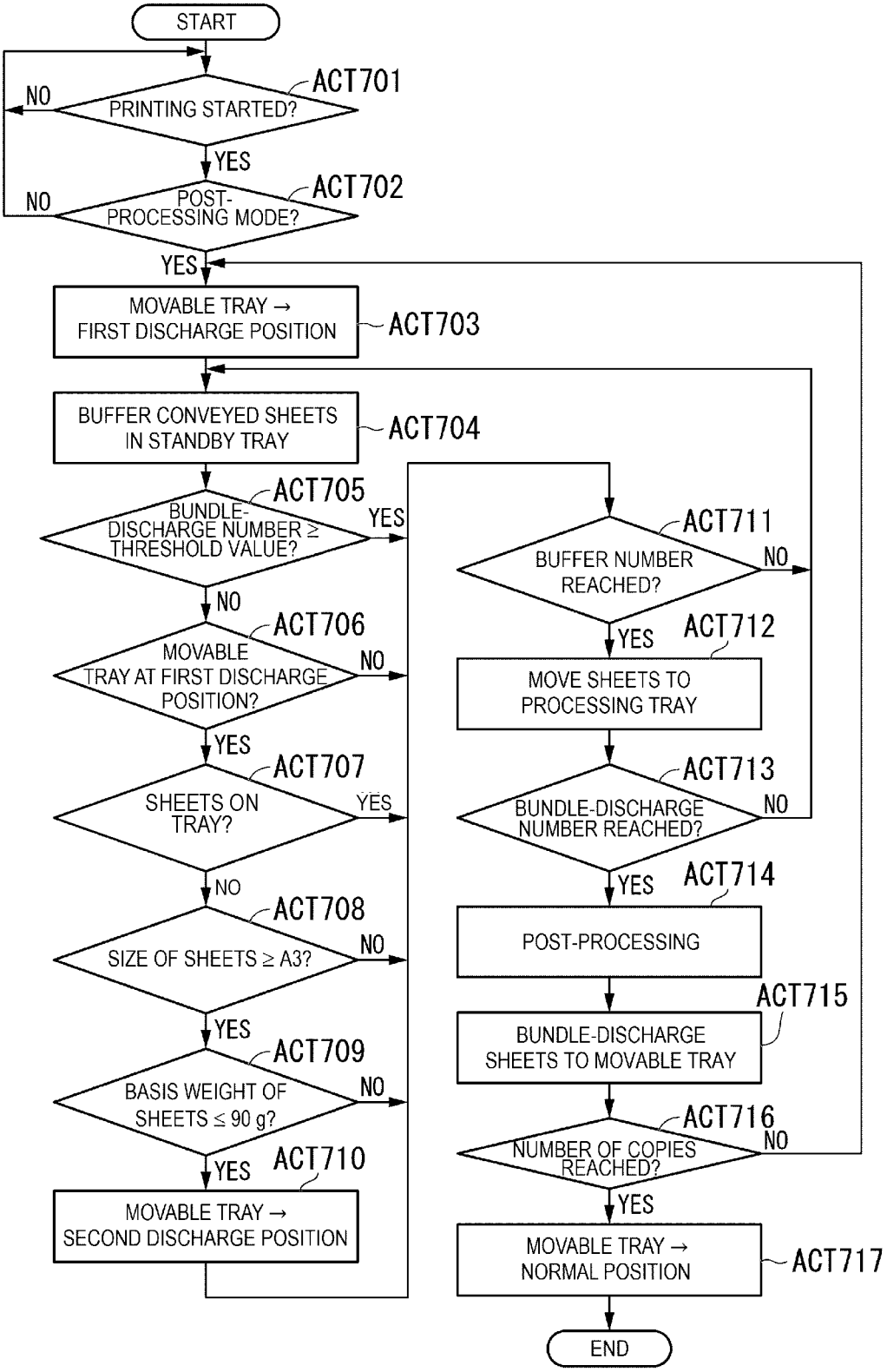
FIG. 12 is a flowchart illustrating an example of discharge processing in a post-processing mode.

FIG. 12 is a flowchart illustrating an example of the discharge processing in the post-processing mode as performed by the image forming device 100. As illustrated in FIG. 12, the image forming device 100 (more particularly, the sheet post-processing device 60) stands by (ACT 701: NO) until a printing is started. When the printing is started (ACT 701: YES), the image forming device 100 determines whether the current printing is in the post-processing mode (ACT 702). When the current printing is not in the post-processing mode (ACT 702: NO), the image forming device 100 returns to ACT 701.

On the other hand, when the current printing is in the post-processing mode (ACT 702: YES), the image forming device 100 moves the movable tray 430 from the normal position to the first discharge position P1 (ACT 703). Then, the image forming device 100 buffers the printed and conveyed sheets St in the standby tray 410 (ACT 704). Next, the image forming device 100 determines whether the presently set bundle discharge number is equal to or greater than a threshold value (for example, 10) (ACT 705). In the sorting processing, since just three sheets are bundle-discharged in this example, ACT 705 is determined as NO. On the other hand, in the stapling processing, 10 or more sheets might be bundle-discharged according to a setting by the user. When the set bundle discharge number is equal to or larger than the threshold value (10) (ACT 705: YES), the image forming device 100 proceeds to ACT 711 without moving the movable tray 430 to the second discharge position P2.

On the other hand, when the set bundle discharge number is less than the threshold value (10) (ACT 705: NO), the image forming device 100 next determines whether the movable tray 430 is at the first discharge position P1 (ACT 706). When the movable tray 430 is not at the first discharge position P1 (ACT 706: No), that is, when the movable tray 430 is already disposed at the second discharge position P2, the image forming device 100 proceeds to ACT 711. On the other hand, when the movable tray 430 is at the first discharge position P1 (ACT 706: YES), the image forming device 100 next determines the presence or absence of the sheets St already on the movable tray 430 (ACT 707).

When the sheets St are already on the movable tray 430 (ACT 707: YES), the image forming device 100 proceeds to ACT 711 without moving the movable tray 430 to the second discharge position P2. If the movable tray 430 is moved to the second discharge position P2 in a state in which the sheets are already on the movable tray 430, some sheets St may flow back to the processing tray 420. Therefore, when the sheets St are already on the movable tray 430, the movable tray 430 is held at the first discharge position P1.

On the other hand, when sheets St are not already on the movable tray 430 (ACT 707: NO), the image forming device 100 next determines whether the size of the sheets is A3 or larger (ACT 708). When the size of the sheets is smaller than A3 (ACT 708: NO), the image forming device 100 proceeds to ACT 711 without moving the movable tray 430 to the second discharge position P2.

If the size of the sheets is A3 or larger (ACT 708: YES), the image forming device 100 next determines whether the per sheet weight (basis weight) of the sheets is equal to or less than 90 g/m$^2$ (ACT 709). When the basis weight of the sheets is not equal to or less than 90 g/m$^2$ (ACT 709: NO), that is, when the basis weight of the sheets exceeds 90 g/m$^2$, the image forming device 100 proceeds to ACT 711 without moving the movable tray 430 to the second discharge position P2. On the other hand, if the basis weight of the sheets is equal to or less than 90 g/m$^2$ (ACT 709: YES), the image forming device 100 then moves the movable tray 430 to the second discharge position P2 (ACT 710).

Then, the image forming device 100 determines whether the number of the sheets standing on the standby tray 410 reaches the buffer number (for example, three) (ACT 711). The buffer number is not always three. For example, when eight sheets are to be post-processed into a bundle or the like, the buffer number is three at the initial buffering and again at the next buffering, but is only two at the last buffering for the 8 sheet bundle.

When the number of the sheets standing by on the standby tray 410 has not yet reached the buffer number (ACT 711: NO), the image forming device 100 returns to ACT 704. On the other hand, if the number of the sheets standing on the standby tray 410 reaches the buffer number (ACT 711: YES), the image forming device 100 moves the sheets St on the standby tray 410 to the processing tray 420 (ACT 712).

Then, the image forming device 100 determines whether the number of the sheets St on the processing tray 420 has reached the bundle discharge number (ACT 713). In a sorting processing, since the bundle discharge number and the buffer number are the same, if ACT 711 is determined as YES, then ACT 713 will also be determined as YES. When the number of the sheets St on the processing tray 420 does not yet reach the bundle discharge number (ACT 713: NO), the image forming device 100 returns to ACT 704. On the other hand, when the number of the sheets St on the processing tray 420 has reached the bundle discharge number (ACT 713: YES), the image forming device 100 post-processes the aligned sheet bundle (ACT 714).

Then, the image forming device 100 bundle-discharges the sheets St to the movable tray 430 by moving the bundle claw 421 from the standby position to the advanced position (ACT 715). Next, the image forming device 100 determines whether the number of copies has been reached (ACT 716). When the number of copies is not yet reached (ACT 716: NO), the image forming device 100 returns to ACT 703. When the number of copies has been reached (ACT 716: YES), the image forming device 100 returns the movable tray 430 to the normal position (ACT 717), and ends the series of processing.

The flowchart description illustrated a case including each of ACT 705, ACT 708, and ACT 709. However, these processes need be not all included, and one or more may be excluded. In addition, the movable tray 430 may be moved to the second discharge position P2 only if all of these processes are satisfied (when all are YES), or if at least one processing is satisfied (when at least one is YES).

As described above, the image forming device 100 changes the position of the movable tray 430 with respect to the processing tray 420 based on the presence or absence of the sheets St on the movable tray 430 to which sheets St are to be discharged from the processing tray 420 for bundling. Accordingly, the resistance force generated by the contact between the sheets St and the movable tray 430 can be made smaller than the conveying force of the tip portions of the sheets St on the movable tray 430 side. Therefore, the sheets St being bundle-discharged from the processing tray 420 can be prevented from being misaligned on the movable tray 430.

The image forming device 100 moves the movable tray 430 to the first discharge position P1 when the post-processing mode is started, and can move the movable tray 430 from the first discharge position P1 to the second discharge position P2 if no sheets St are on the movable tray 430. Accordingly, since the movable tray 430 can stand by at the first discharge position P1, which is higher than the normal position, the movable tray 430 can be immediately moved to the second discharge position P2. Therefore, the speed of the bundle discharging of the sheets St can be prevented from being slowed. Therefore, the speed of outputting of the sheets St can be prevented from dropping and occurrence of misalignment on the movable tray 430 when bundle-discharged can be prevented.

In an embodiment, the difference in height between the processing tray 420 and the movable tray 430 at the connection position thereof is the first difference H1 at the first discharge position P1, and the difference is the second difference H2 (less than the first difference H1) at the second discharge position P2. Accordingly, the resistance force generated by the contact between the sheets St and the movable tray 430 can be made smaller than the conveying force of the tip portions of the sheets St on the movable tray 430 side. Therefore, the sheets St bundle-discharged from the processing tray 420 can be prevented from being deflected on the movable tray 430.

When no sheets St are on the movable tray 430, the image forming device 100 according to an embodiment may change the position of the movable tray 430 based on at least one of the size of the sheets St and the weight of the sheets St. Accordingly, even when sheets St having a long size or sheets St having a weak stiffness are included in the bundle-discharged sheets St, the sheets St bundle-discharged from the processing tray 420 can be efficiently prevented from being deflected on the movable tray 430.

The image forming device 100 determines the presence or absence of the sheets St on the movable tray 430 for each sheet St conveyed until the number of the sheets on the processing tray 420 reaches the bundle discharge number, and changes the position of the movable tray 430 based on the determination result (Sheets St on movable tray 430, YES/NO?) of each sheet conveyed to the processing tray 420. Accordingly, even if the sheets St on the movable tray 430 are removed by a user during the printing, the sheets St bundle-discharged from the processing tray 420 can still be prevented from being misaligned on the movable tray 430.

When the bundle discharge number is equal to or greater than a threshold value, the image forming device 100 does not change the position of the movable tray 430 regardless of the presence or absence of the sheets St on the movable tray 430. Accordingly, when the bundle discharge number is large, and the deflection of the sheets St is less likely to occur, the control to move the movable tray 430 to the second discharge position P2 can be omitted. Therefore, a load of the processing relating to the bundle discharge can be reduced.

Next, modifications will be described. In each of the following, differences from the above-described embodiments will be mainly described. In addition, each of the described modifications may be combined with the above-described embodiment and each other to the extent technically feasible.

First, a first modification will be described. The above-described embodiment included a sheet post-processing device 60 that moves the position of the movable tray 430 in a height direction based on the presence or absence of the sheets St on the movable tray 430. The first modification includes a sheet post-processing device 60 that changes an angle of the movable tray 430 based on the presence or absence of the sheets St on the movable tray 430.

Figure 13:
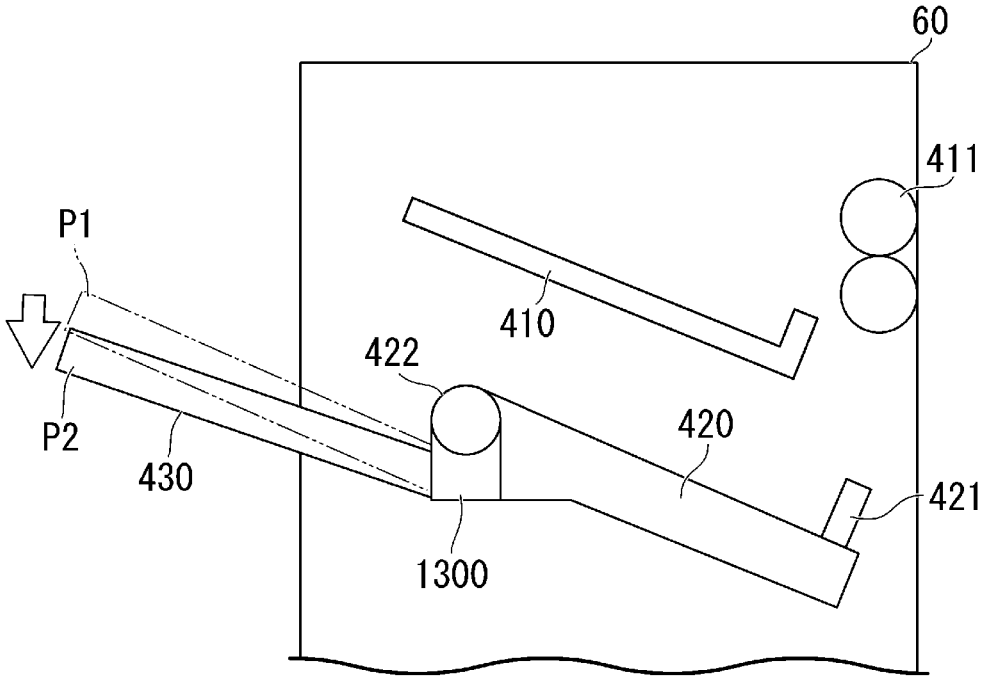
FIG. 13 depicts aspects related to a modification example when the position of a movable tray is changed.

FIG. 13 is an explanatory diagram illustrating this modification when the position of the movable tray 430 is changed. In the modification, the movable tray 430 includes a swingable mechanism with a support unit 1300 as a support shaft. As illustrated in FIG. 13, at the second discharge position P2, the movable tray 430 is tilted so as to be closer to parallel with the support unit 1300 than at the first discharge position P1. Specifically, at the second discharge position P2, the movable tray 430 is tilted such that the surface of the movable tray 430 is closer to parallel to the surface of the processing tray 420 than at the first discharge position P1.

Figure 14:
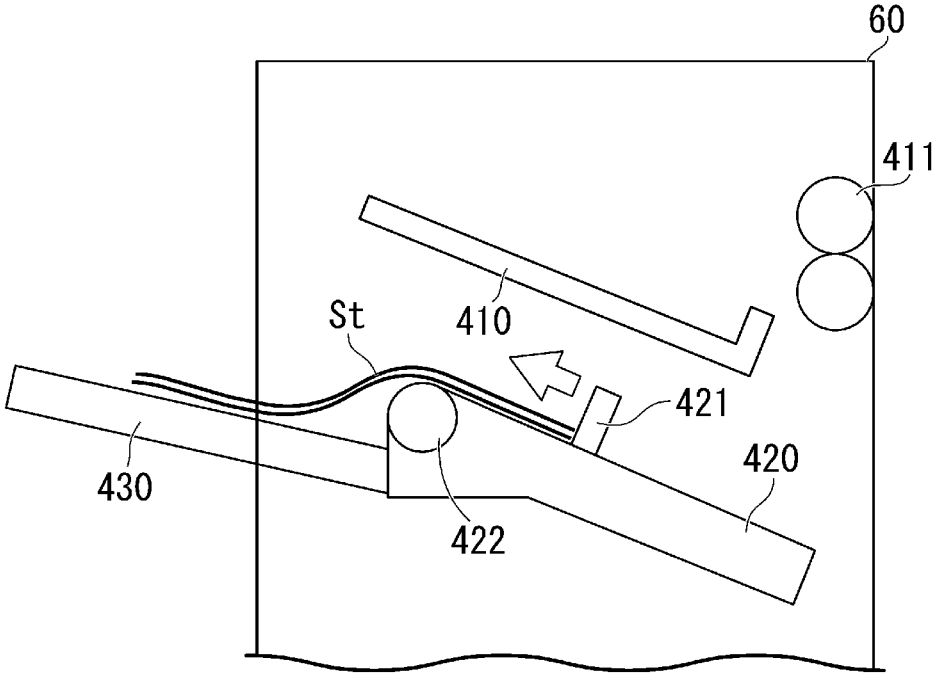
FIG. 14 depicts an operation example of bundle discharge when the movable tray is moved to another discharge position in a modification example.

FIG. 14 is an explanatory diagram illustrating an operation example of the bundle discharge when the movable tray 430 is moved to the second discharge position P2 in the modification. In FIG. 14, it is assumed that no sheets St are initially on the movable tray 430. Since the surface of the processing tray 420 and the surface of the movable tray 430 are close to parallel, the resistance force generated by the contact between the sheets St and the movable tray 430 can be made smaller than the conveying force of the tip portions of the sheets St on the movable tray 430 side, even when no sheets St are present. Therefore, the deflection of the sheets St is less likely to occur, and the sheets St can be discharged to the movable tray 430.

According to this modification, the sheets St bundle-discharged from the processing tray 420 can be prevented from being misaligned on the movable tray 430.

Next, a second modification will be described. The above-described embodiment included a sheet post-processing device 60 in which the movable tray 430 can be disposed at two positions, that is, the first discharge position P1 and the second discharge position P2. The second modification includes a sheet post-processing device 60 in which the movable tray 430 can be disposed at three positions, that is, the first discharge position P1, the second discharge position P2, and a third discharge position.

In the second modification, the placement control unit 503 can also dispose the movable tray 430 at the third discharge position, which is an intermediate position between the first discharge position P1 and the second discharge position P2. Specifically, for example, the third discharge position is a position where the difference in height between the surface of the processing tray 420 and the surface of the movable tray 430 is smaller than the difference at the first discharge position P1, but larger than the difference at the second discharge position P2.

When the size of the sheets St is slightly larger than standard size, the placement control unit 503 moves the movable tray 430 to the third discharge position. For example, when the sheets are B4 size being discharged in the longitudinal direction. The predetermined size may be, for example, a sheet size larger than A4 but smaller than A3.

Further, when the stiffness of the sheets St is slightly weaker (in a case of a predetermined basis weight) than standard, the placement control unit 503 moves the movable tray 430 to the third discharge position. The predetermined basis weight (X $g/m^2$) in this context is, for example, in a range of 90 $g/m^2$<X $g/m^2$100 $g/m^2$.

When the bundle discharge number is slightly larger (when the predetermined number is Y), the placement control unit 503 moves the movable tray 430 to the third discharge position. The predetermined number in this context is, for example, in a range of $10 \leq Y < 15$.

According to the second modification, even when sheets St having a slightly longer size or sheets St having a slightly weaker stiffness are included in the bundle-discharged sheets St, or when the bundle discharge number is slightly larger, the sheets St bundle-discharged from the processing tray 420 can be efficiently prevented from being deflected on the movable tray 430.

In the second modification, the discharge position of the movable tray 430 is set to three different discharge positions. However, the modification is not limited thereto, and the discharge position of the movable tray 430 may be set to four or more different discharge positions.

Described functions of the image forming device 100 (and/or the sheet post-processing device 60) may be implemented by a computer executing instructions of a software program or the like. In this case, such a program may be recorded on a non-transitory, computer-readable recording medium. In this context, "computer-readable recording medium" refers to a storage device such as a portable medium such as a flexible disk, a magneto-optical disk, a ROM, and a CD-ROM, or a hard disk. Further, the "computer-readable recording medium" may be accessed or downloaded via a communication line such as a network such as the Internet a telephone line. The program may be a program for implementing a part of the functions, or may be a program capable of implementing the functions in combination with programs already recorded in the computer system, such as an operating system.

While certain embodiments have been described, these embodiments have been presented by way of example only, and are not intended to limit the scope of the disclosure. These embodiments can be implemented in other various forms, and various omissions, replacements, and changes can be made without departing from the spirit of the disclosure. These embodiments and modifications thereof are included in the scope and spirit of the invention, as well as in the scope of the invention described in the scope of claims and the equivalent scope thereof.

What is claimed is:

1. A sheet post-processing device, comprising:

a first tray to receive sheets from an image forming unit;

a second tray to receive sheets from the first tray;

a third tray to receive sheets from the second tray, the third tray being movable relative to the second tray;

a bundle claw configured to move sheets in a first direction from the second tray to the third tray; and a controller configured to move the third tray relative to the second tray according to the sheets on the second tray, wherein the controller is configured to determine the presence or absence of sheets on the third tray, and the controller determines the presence or absence of sheets on the third tray each time a sheet is discharged to the first tray from the image forming unit.

2. The sheet post-processing device according to claim 1, wherein the controller is configured to cause a post-processing operation to be performed on the sheets on the second tray when the number of sheets on the second tray reaches a predetermined bundle number.

3. The sheet post-processing device according to claim 1, further comprising:

a discharge roller between the second tray and the third tray in the first direction.

4. The sheet post-processing device according to claim 1, wherein the controller is configured to:

move the third tray to a first position when a post processing mode is started, and change the position of the third tray from the first position to a second position different from the first position in the post processing mode if sheets are on the third tray when additional sheets are to be moved from the second tray to the third tray.

5. The sheet post-processing device according to claim 4, wherein a difference in height between the second tray and the third tray is a first difference when the third tray is at the first position, and a difference in height between the second tray and the third tray is a second difference that is less than the first difference when the third tray is at the second position.

6. The sheet post-processing device according to claim 1, wherein the controller is configured to change the position of the third tray based on a size of the sheets on the second tray if no sheets are on the third tray.

7. The sheet post-processing device according to claim 1, wherein the controller is configured to change the position of the third tray based on a sheet type of the sheets on the second tray if no sheets are on the third tray.

8. The sheet post-processing device according to claim 1, wherein the controller is configured to change the position of the third tray based on a sheet weight of the sheets on the second tray if no sheets are on the third tray.

9. An image forming apparatus, comprising:

an imaging forming unit configured to form images on a sheet;

a sheet post-processing device including:

a first tray to receive sheets from the image forming unit;

a second tray to receive sheets from the first tray;

a third tray to receive sheets from the second tray, the third tray being movable relative to the second tray; and a bundle claw configured to move sheets in a first direction from the second tray to the third tray; and a controller configured to move the third tray relative to the second tray according to the sheets on the second tray, wherein the controller is configured to determine the presence or absence of sheets on the third tray each time a sheet is discharged to the first tray from the image forming unit.

10. The image forming apparatus according to claim 9, wherein the controller is configured to cause a post-processing operation to be performed on the sheets on the second tray when the number of sheets on the second tray reaches a predetermined bundle number.

11. The image forming apparatus according to claim 9, further comprising:

a discharge roller between the second tray and the third tray in the first direction.

12. The image forming apparatus according to claim 9, wherein the controller is configured to:

move the third tray to a first position when a post processing mode is started, and change the position of the third tray from the first position to a second position different from the first position in the post processing mode if sheets are on the third tray when additional sheets are to be moved from the second tray to the third tray.

13. The image forming apparatus according to claim 12, wherein a difference in height between the second tray and the third tray is a first difference when the third tray is at the first position, and a difference in height between the second tray and the third tray is a second difference that is less than the first difference when the third tray is at the second position.

14. The image forming apparatus according to claim 9, wherein the controller is configured to change the position of the third tray based on a size of the sheets on the second tray if no sheets are on the third tray.

15. The image forming apparatus according to claim 9, wherein the controller is configured to change the position of the third tray based on a sheet type of the sheets on the second tray if no sheets are on the third tray.

16. The image forming apparatus according to claim 9, wherein the controller is configured to change the position of the third tray based on a sheet weight of the sheets on the second tray if no sheets are on the third tray.

* * * * *